United States Patent [19]

Csaki

[11] 4,047,778

[45] Sept. 13, 1977

[54] APPARATUS FOR CONVERTING CRT CATHODES

[75] Inventor: Julius A. Csaki, Colorado Springs, Colo.

[73] Assignee: Hewlett-Packard Company, Palo Alto, Calif.

[21] Appl. No.: 623,148

[22] Filed: Oct. 16, 1975

[51] Int. Cl.[2] ..... H01J 9/385

[52] U.S. Cl. ..... 316/18; 316/1; 316/27

[58] Field of Search ..... 316/18, 24, 27, 30, 316/1

[56] References Cited

U.S. PATENT DOCUMENTS 3,434,770 3/1969 Angelucci et al. ..... 316/1

*Primary Examiner*—Richard B. Lazarus

*Attorney, Agent, or Firm*—William E. Hein

[57] ABSTRACT

Vacuum pump exhaust manifold pressure is employed to control the conversion voltage applied during a CRT conversion process for enabling conversion of CRT cathodes in a nearly constant vacuum environment.

7 Claims, 6 Drawing Figures

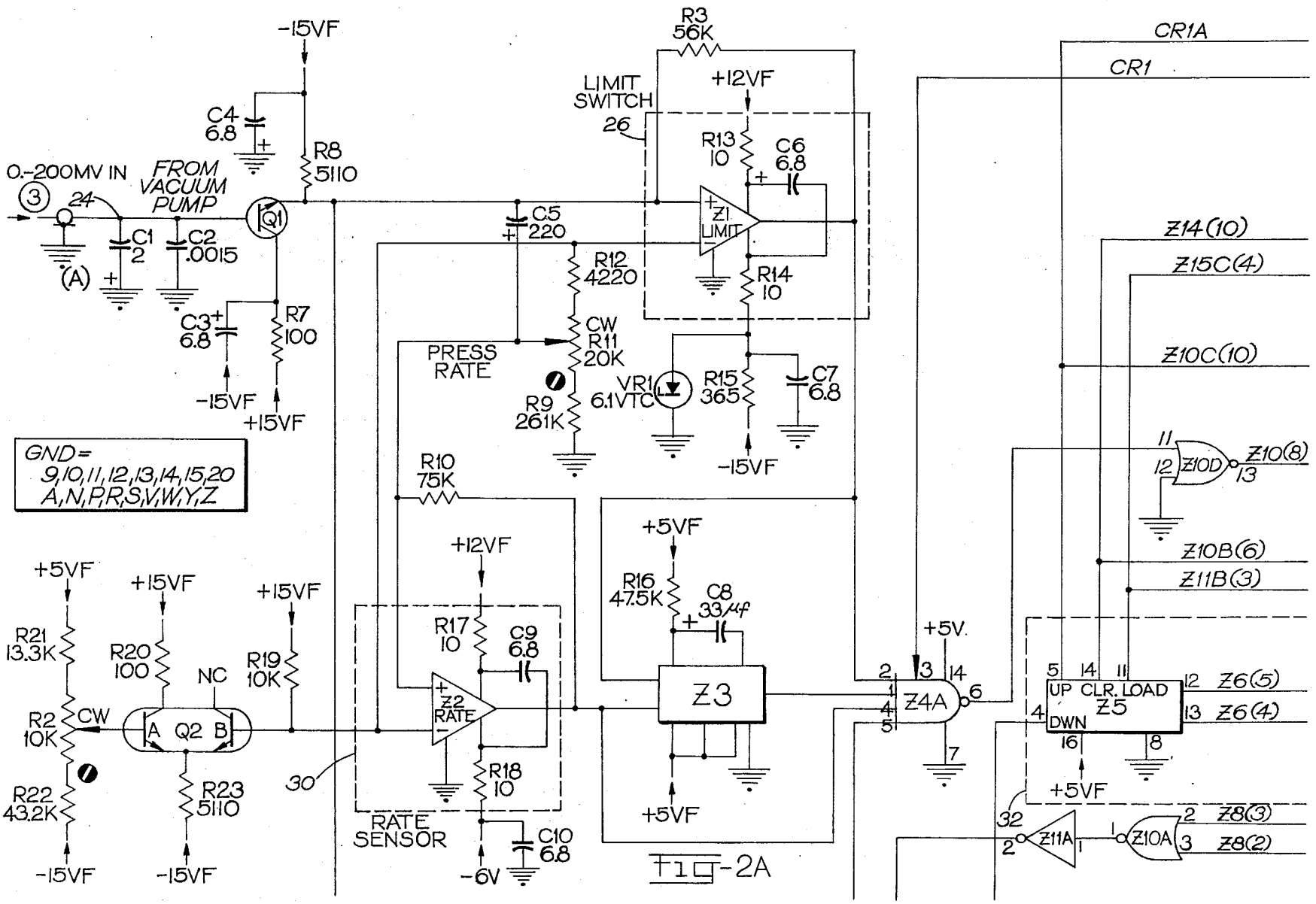
CR1A
CR1
Z14(10)
Z15C(4)
Z10C(10)
Z10D
Z10(8)
Z10B(6)
Z11B(3)
Z6(5)
Z6(4)
Z8(3)
Z8(2)
Z10A
Z11A
Z5
UP CLR LOAD
DWN
+5VF
32
+5V
Z4A
+12VF
R3 56K
R13 10
C6 6.8
Z1 LIMIT
R14 10
C7 6.8
R15 365
-15VF
VR1 6.1VTC
LIMIT SWITCH
26
R12 4220
CW R11 20K
R9 261K
C5 220
PRESS RATE
R10 75K
C8 33μf
Z3
R16 47.5K
+5VF
+5VF
-2A
C9 6.8
R17 10
Z2 RATE
R18 10
C10 6.8
-6V
RATE SENSOR
30
-15VF
R8 5110
C4 6.8
Q1
R7 100
C3 6.8
+15VF
-15VF
FROM VACUUM PUMP
C2 .0015
C1 2
24
0-200MV IN
(A)
GND= 9,10,11,12,13,14,15,20 A,N,P,R,S,V,W,Y,Z
+15VF
R19 10K
NC
Q2
R23 5110
-15VF
+15VF
R20 100
+5VF
R21 13.3K
CW
R2 10K
R22 43.2K
-15VF Q1, Q4, Q5, Q6, Q7 ARE 2N3904
Q2, Q3 ARE 2N2453A
Z1, Z2, Z18 ARE LM710C
Z3 IS 74L122
Z4 IS MC830
Z5, Z6, Z7, Z8 ARE 74193
Z9, Z17 ARE 741C
Z10 IS 74LO2
Z11 IS 7404
Z12, Z13, Z16 ARE 555
Z14 IS 7476
Z15 IS LM309
Z20 IS 7812
R2 AND R6 ARE HELITRIM 10 TURN.
ALL DIODES ARE SILICON SWITCHING DIODES.
ALL FIXED RESISTORS 1/8W, 1%, MF UNLESS NOTED.
ALL CAPACITORS IN μf.

Z6(2)
R33 100
R34 10K
Q7
(18)
STEP LIGHT
+5VF
NC
Z4B
Z15B
Z16
Z11E
Z18 LIMIT
LIMIT SWITCH 28
R31 12.1K
C12 .01
C13 100
R32 301K
C11 6.8
R30 10
R29 10
R66 56K
-6V
+12VF
+15VF
-15VF
R28 10K
R26 5110
Q3
R27 100
R24 43.3K
R6 10K
R25 432K
CW
W
+5V TO LEDS
E
B
Z19
Z20
15Ω 3W
C20 2
C23 2
C21 .22
C22 .22
C24 6.8
C25 6.8
R64 10
R65 10
+15V
-15V
+30V
+30VF
2
1

Z15A
Z11C
+5VF
5.11K
CLOCK
34
Q6
10K
(20)
(19)
(21)
W
TO FIL SUPPLY
BUFFER DRIVER
16
18
Z9
Z17
VR 11V
+30V
-15VF
R42 10K
R63 10K
GAIN
NC
20
22
R41 243K
R40 17.8K
R39 3650
R43 3650
R44 17.8K
R45 243K
PROG SW
R48 33.2K
R47 8250
R36 8250
R38 33.2K
R35 7500
R37 2000
R49 7500
R46 2000
CW
40
ZD441 DAC
MSB
LSB
DIG GND
FS ADJ
ZERO ADJ
R3 20K
R4 20K
R34
DIGITAL TO ANALOG CONVERTER

APPARATUS FOR CONVERTING CRT CATHODES

BACKGROUND AND SUMMARY OF THE INVENTION

This invention relates generally to a cathode ray tube (CRT) and more particularly to the activation or conversion of one or more cathode elements of such a tube during the production thereof.

Several prior art cathode conversion techniques have been employed in CRT production processes. One such technique follows a fixed time schedule during which the applied filament voltage is varied in several discrete steps from approximately 25% of hotshot voltage to full hotshot voltage. This procedure is disadvantageous is that it is conducted without regard for tube vacuum, with the attendant result that CRT cathodes are converted at various vacuum levels depending on the amount of outgassing present in an individual tube. Conversion at insufficient vacuum levels has been found to be detrimental to cathode performance and life.

It is therefore the principal object of this invention to provide an apparatus for conversion of CRT cathodes in which vacuum pump exhaust manifold pressure is continuously monitored during the conversion process so that cathode conversion is accomplished under nearly constant vacuum conditions.

This object is accomplished in accordance with the illustrated preferred embodiment of the invention by employing control circuitry for supplying a steadily increasing voltage for application to the CRT filaments during cathode conversion, for sensing the tube vacuum during the conversion process, for preventing an increase in the applied voltage if tube vacuum falls below a first predetermined level, and for initiating a reduction in the applied voltage in the event tube vacuum falls below a second predetermined level.

DESCRIPTION OF THE PREFERRED EMBODIMENT

Figure 1:
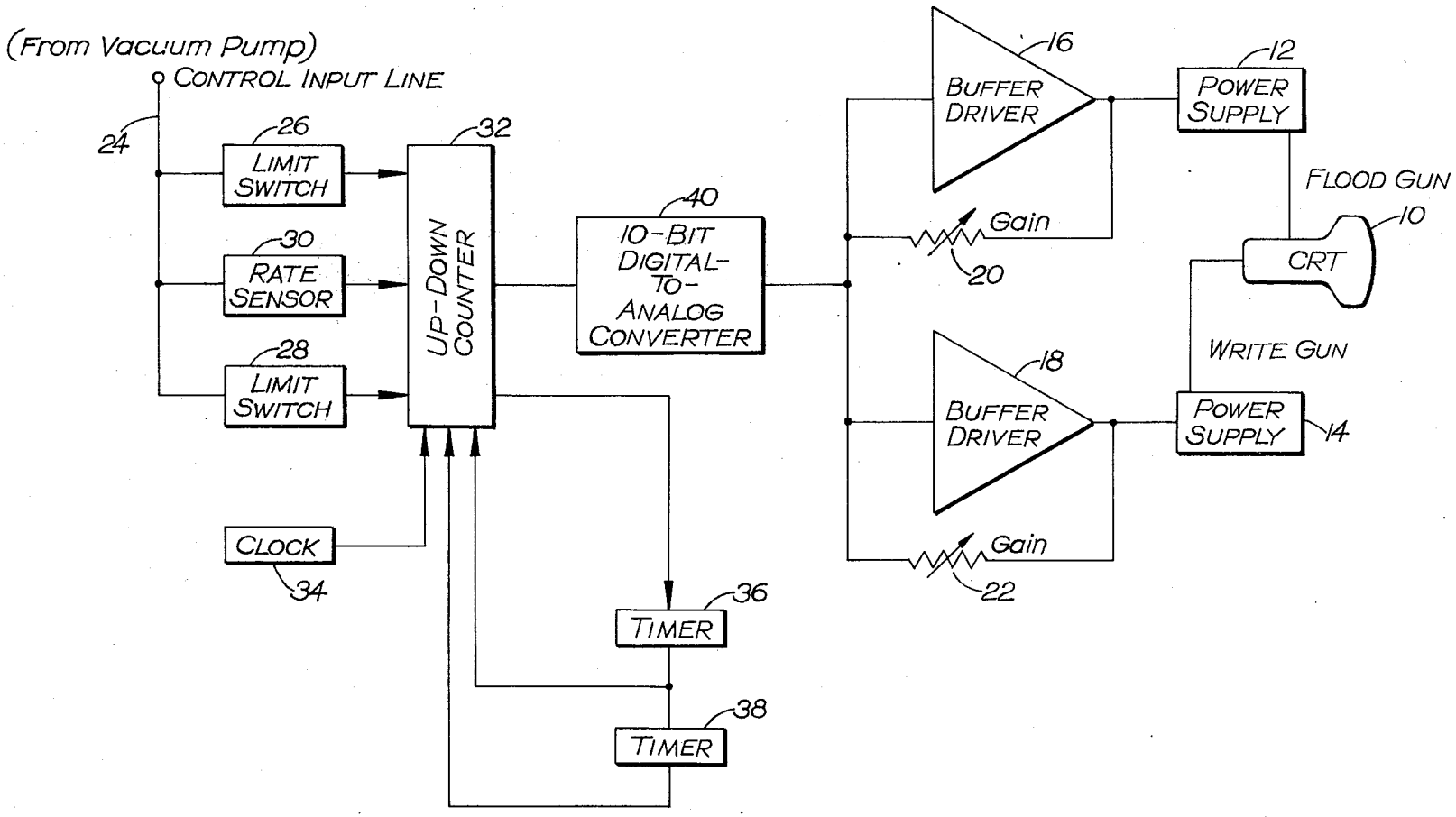
FIG. 1 is a block diagram of logic and control circuitry comprising a CRT cathode conversion apparatus in accordance with the preferred embodiment of the invention.

Referring now to the block diagram of FIG. 1, there is shown a CRT 10 having write gun and flood gum cathodes to be converted. The filaments associated with these cathodes are separately connected to programmable power supplies 12 and 14, each of which provides a source of voltage for converting the associated cathode. It is desirable to employ remote sensing of connection with power supplies 12 and 14 to avoid regulation problems that would otherwise occur as a result of the voltage drop in the leads between the power supplies and the CRT filaments. These power supplies are driven by buffer drivers 16 and 18. A pair of gain controls 20 and 22 associated with buffer drivers 16 and 18, respectively, are employed to select any one of several hotshot voltages, depending on the type of CRT filament currently in use.

Figure 2:
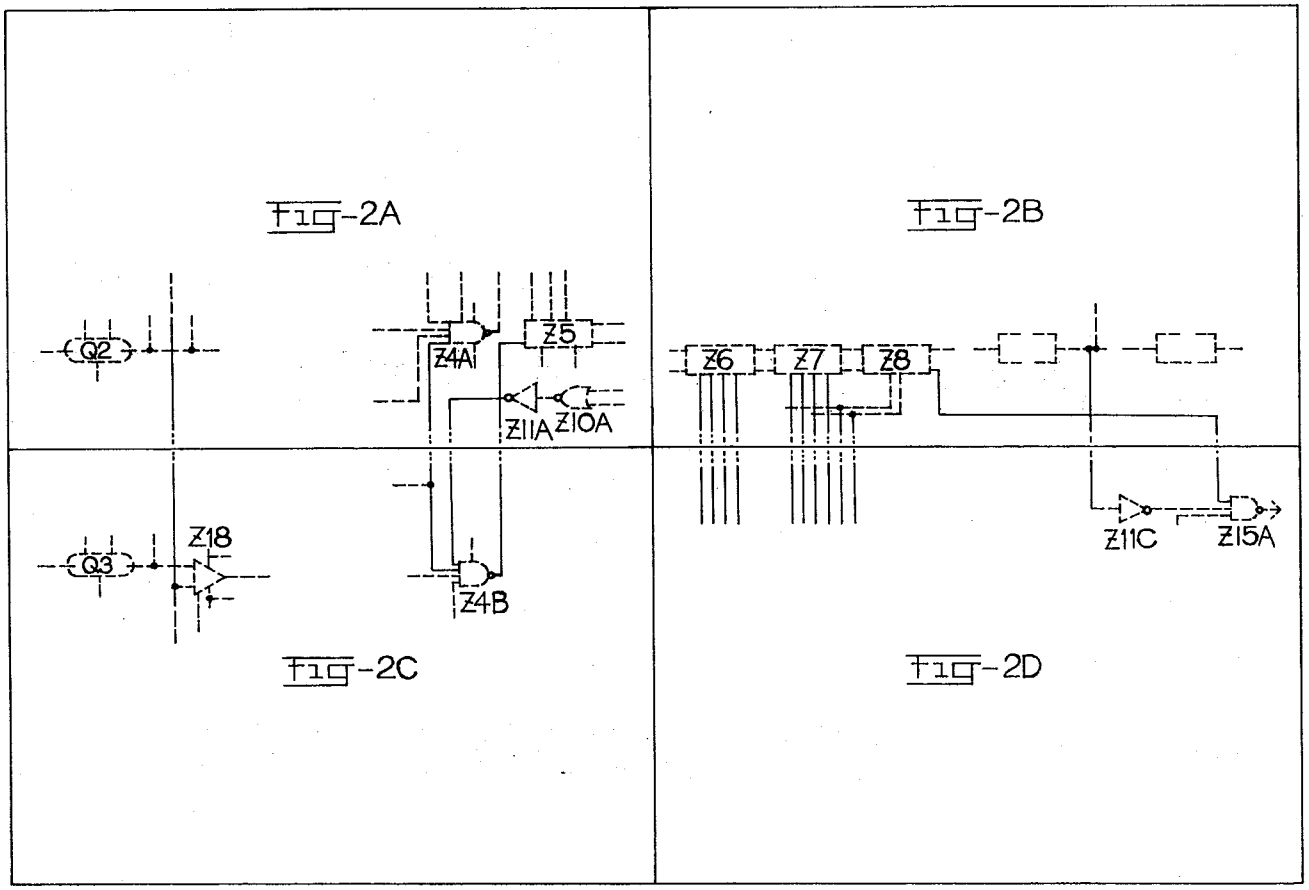
FIGS. 2A–D are a detailed schematic diagram of a preferred circuit implementation of the CRT cathode conversion apparatus of FIG. 1.
Figure 2B:
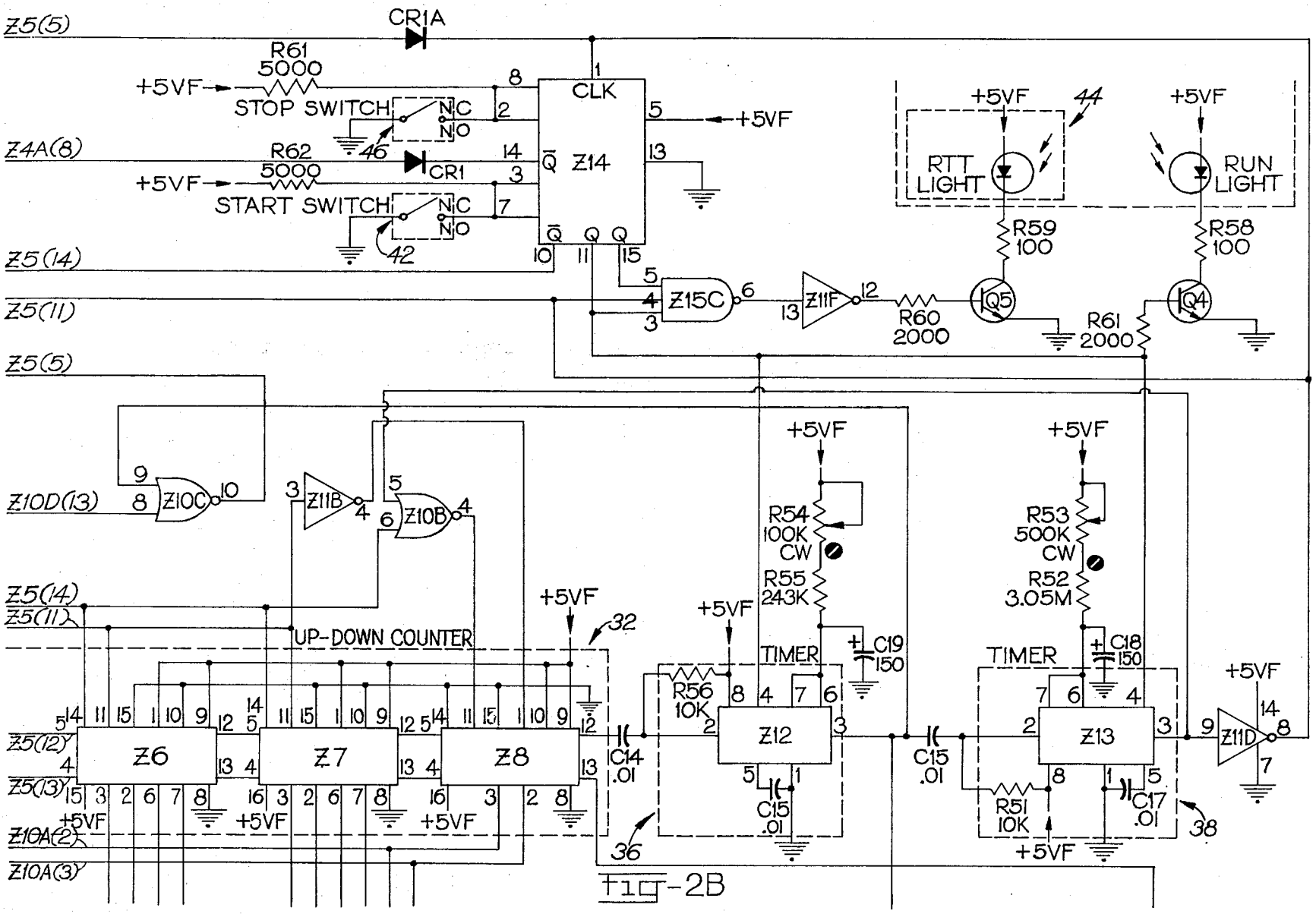
Figure 2C:
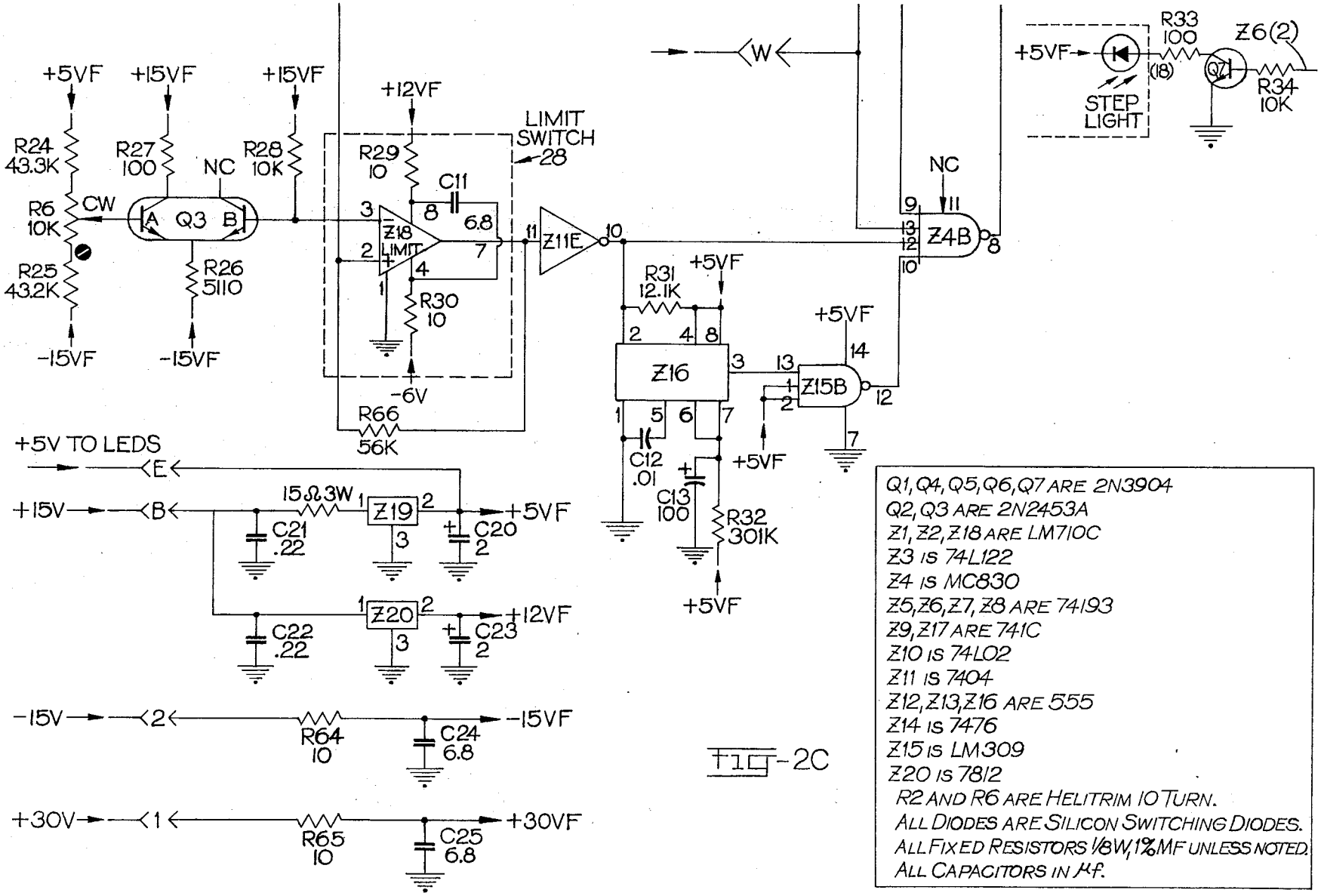
Figure 2D:
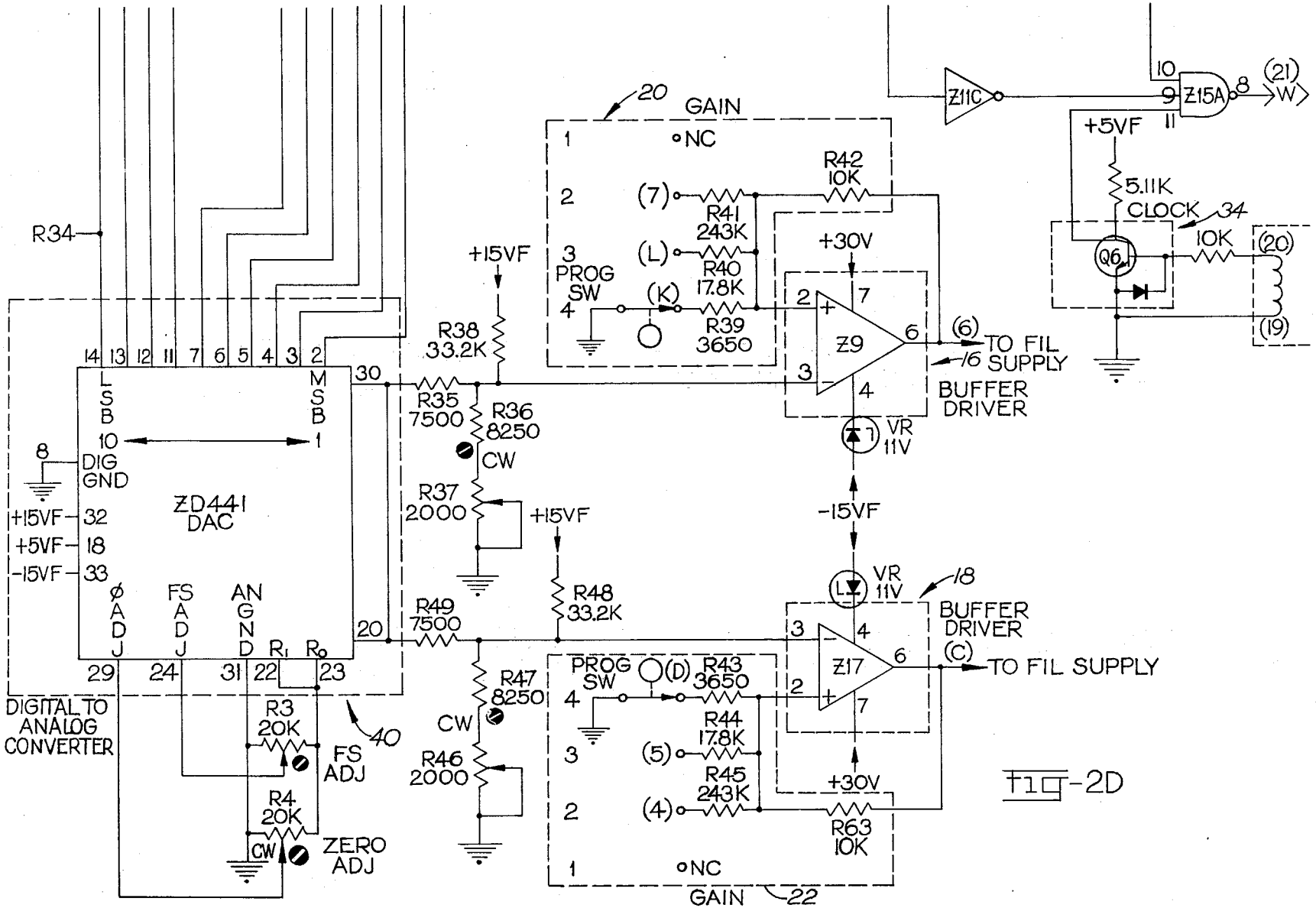

A control input line 24 is provided from an external vacuum pump employed to exhaust the CRT. Control input line 24 carriers a control voltage that is linearly inversely proportional to CRT vacuum. This line is connected as an input to a pair of limit switches 26 and 28 and to a rate sensor 30. The individual outputs of limit switches 26 and 28 and rate sensor 30 are connected as inputs to a binary up-down counter 32. A clock 34 and first and second timers 36 and 38 provide additional inputs to up-down counter 32. The binary output of up-down counter 32 is connected to a 10-bit digital-to-analog converter 40 which in turn controls buffer drivers 16 and 18. The block diagram of FIG. 1 may be implemented by means of circuitry shown in the detailed schematic diagram of FIGS. 2A–B.

Cathode conversion is accomplished by first establishing an appropriate level of CRT vacuum by means of an external vacuum pump. During the time that this vacuum level is being established, operating power may be applied to the conversion apparatus, which in turn applies 25% of hotshot voltage to the CRT filaments. This voltage level is not destructive to the CRT regardless of the existing vacuum level. When a chosen conversion vacuum level has been reached, the conversion process may be continued by actuating a start switch 42 illustrated in the detailed schematic diagram of FIGS. 2A–B. Start switch 42 initiates up-counting in up-down counter 32 based on the clock pulses generated by clock 34. The binary countoutput of up-down counter 32 is converted to an analog voltage by digital-to-analog converter 40. The resulting analog voltage is applied to buffer drivers 16 and 18 which in turn control the voltage output of power supplies 12 and 14.

As long as the voltage control input line 24 does not exceed a predetermined limit that corresponds to the minimum CRT vacuum at which conversion may safely take place, up-down counter 32 will continue to count pulses supplied by clock 34 until it becomes full. For example, in the production of a certain type of CRT the frequency of pulses generated by clock 34 is adjusted so that up-down counter 32 will become full in about 4 minutes, 35 seconds. During this time, the increasing binary count output of up-down counter 32 is converted to a linearly increasing analog voltage by digital-to-analog converter 40. This increasing analog voltage applied to buffer drivers 16 and 18 results in a voltage that linearly increases from 25% of hotshot voltage to full hotshot voltage being applied to the CRT filaments. When up-down counter 32 becomes full, timer 36 is triggered and disables the up-down counter 32, thus allowing application of the full hotshot voltage to the CRT filaments.

According to the illustrated preferred embodiment of the invention, timer 36 is arranged to time out in 35 seconds. At that point, timer 38 is triggered and forces the output of the up-down counter 32 to a value such that 75% of hotshot voltage is applied to the CRT filaments. In the illustrated preferred embodiment of the invention timer 38 is preset so that 75% of hotshot voltage is applied to the CRT filaments for 12 minutes. At the end of that time period an RTT indicator 44 signals the operator to seal off the tube. When the tube has been sealed the conversion process is halted by actuating a stop switch 46.

In practice, the CRT vacuum rarely remain constant enough to allow the conversion process to systematically proceed as just described. Due to normal outgassing in the CRT during the conversion process, significant variations in the CRT vacuum level are encountered. The present cathode conversion apparatus has been arranged to insure that the CRT cathodes are converted while maintaining a relatively constant high vacuum in the CRT. If, during the conversion process, the voltage on control input line 24 increases to a predetermined level indicative of a vacuum level that is insufficient to allow the conversion process to safely continue, limit switch 26 is automatically actuated. This halts up-counting in up-down counter 32, thus holding the previously achieved voltage at the CRT filaments and preventing a further increase in that voltage. Due to the time lag betweem the vacuum level in the CRT and that at the vacuum pump, the vacuum level in the CRT may continue to fall after limit switch 26 has been actuated. Such a continuing decrease in CRT vacuum will, at a predetermined level, trigger limit switch 28. Limit switch 28 in turn commands up-down counter 32 to begin down-counting, thereby decreasing the voltage applied to the CRT filaments. When the vacuum has overcome the outgassing action in the tube to the point that the vacuum level in the tube has been restored to the level to which limit switch 28 is preset, limit switch 28 is again triggered, this time halting the down-counting in up-down counter 32. Further improvement in the vacuum level within the tube triggers limit switch 26, thus again beginning up-counting in up-down counter 32. The process is repeated in response to subsequent periods of tube outgassing until up-down counter 32 becomes full, thereby applying full hotshot voltage to the CRT filaments. Rate sensor 30 is provided to monitor the rate of change of voltage on control input line 24. When a very rapid decrease in vacuum level takes place, rate sensor 30 acts to halt the up-counting in up-down counter 32 even before limit switch 26 is triggered.

Application of the present apparatus and method for converting CRT cathodes has been found to yield more uniform cathodes than have resulted from the use of prior art conversion methods. Test results have shown the present apparatus and method to be applicable to a variety of different CRT types and to work well with various vacuum systems. While the time required to perform a complete conversion cycle may, depending upon the amount of outgassing present in a particular tube, be somewhat longer than the required under the various prior art conversion methods involving fixed time schedules, the resulting improvements in cathode performance far outweight any time disadvantage.

I claim:

1. Apparatus for converting a cathode of a cathode ray tube (CRT) during the manufacture of the CRT, the apparatus comprising:

power supply means for applying a conversion voltage to a CRT filament associated with the CRT cathode to be converted;

vacuum pump means for establishing a vacuum condition within the CRT;

vacuum sensing means for detecting the vacuum level within the CRT during conversion; and logic means coupled to said power supply means and vacuum sensing means, said logic means being responsive to said vacuum sensing means for causing said conversion voltage to steadily increase from a first predetermined voltage level to a second predetermined voltage level so long as the vacuum level within the CRT is greater than a first predetermined vacuum level, said logic means being responsive to said vacuum sensing means for causing said conversion voltage to steadily decrease from the most recently achieved voltage level toward said first predetermined voltage level if the vacuum level within the CRT falls below a second predetermined vacuum level that is lower than said first predetermined vacuum level, said logic means being responsive to said vacuum sensing means for preventing any increase or decrease in the most recently achieved conversion voltage so long as the vacuum level within the CRT is between said first and second predetermined vacuum levels.

2. Apparatus for converting a cathode of a CRT as in claim 1 wherein:

said vacuum sensing means includes a first limit switch for detecting said first predetermined vacuum level and a second limit switch for detecting said second predetermined vacuum level; and said logic means includes a clock for generating a train of clock pulses, an up-down counter for receiving and storing said clock pulses, and a digital-to-analog converter for converting the clock pulses stored in said up-down counter to an analog voltage for controlling said power supply means.

3. Apparatus for converting a cathode of a CRT as in claim 1 wherein:

said logic means is responsive to the condition wherein said conversion voltage has reached said second predetermined voltage level for maintaining that voltage level for a first predetermined period of time;

said logic means is responsive to expiration of said first predetermined period of time for immediately reducing said conversion voltage to a third predetermined voltage level and for maintaining that voltage level for a second predetermined period of time; and said logic means is responsive to expiration of said second predetermined period of time for providing an indication to an operator that conversion has been completed.

4. Apparatus for converting a cathode of a CRT as in claim 2 wherein:

said logic means is responsive to the condition wherein said conversion voltage has reached said second predetermined voltage level for maintaining that voltage level for a first predetermined period of time;

said logic means is responsive to expiration of said first predetermined period of time for immediately reducing said conversion voltage to a third predetermined voltage level and for maintaining that voltage level for a second predetermined period of time; and said logic means is responsive to expiration of said second predetermined period of time for providing an indication to an operator that conversion has been completed.

5. Apparatus for converting a cathode of a CRT as in claim 1 wherein:

said logic means includes rate sensor means for detecting the rate of decrease in the vacuum level within the CRT; and said logic means is responsive to detection by said rate sensor means of a rate of decrease in the vacuum level within the CRT that exceeds a predetermined rate of decrease for temporarily preventing any increase in said conversion voltage.

6. A method for converting a cathode of a cathode ray tube (CRT) during the manufacture of the CRT, the method comprising:

establishing a vacuum condition within the CRT;

applying a conversion voltage to a CRT filament associated with the CRT cathode to be converted, the conversion voltage steadily increasing from a first predetermined voltage level to a second predetermined voltage level so long as the vacuum level within the CRT is greater than a first predetermined vacuum level;

applying a conversion voltage to the CRT filament associated with the CRT cathode to be converted, the conversion voltage steadily decreasing from the most recently achieved voltage level toward said first predetermined voltage level if the vacuum level within the CRT falls below a second predetermined vacuum level that is lower than said first predetermined vacuum level;

applying a conversion voltage to the CRT filament associated with the CRT cathode to be converted, the conversion voltage being a constant voltage equal to the most recently achieved voltage level so long as the vacuum level within the CRT is between said first and second predetermined vacuum levels.

7. A method for converting a cathode of a CRT as in claim 4 further comprising the steps of:

maintaining said conversion voltage constant at said second predetermined voltage level for a first predetermined period of time after the voltage level has been achieved;

reducing said conversion voltage to a third predetermined voltage level after the expiration of said first predetermined period of time; and maintaining said conversion voltage at said third predetermined voltage level for a second predetermined period of time.

* * * * *

UNITED STATES PATENT AND TRADEMARK OFFICE

CERTIFICATE OF CORRECTION

PATENT NO. : 4,047,778

DATED : September 13, 1977

INVENTOR(S) : Julius A. Csaki

It is certified that error appears in the above-identified patent and that said Letters Patent are hereby corrected as shown below:

Column 1, line 15, cancel "is" (second occurrence) and substitute --in--; line 51, cancel "gum" and substitute --gun--;

Column 2, line 31, immediately after "voltage" insert --on--;

Column 3, line 17, immediately after "vacuum" insert --pump--; line 25, cancel "The" and substitute --This--; line 43, cancel "the" (first occurrence) and substitute --that--;

Column 6, line 10, cancel "the" and substitute --that--.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*